US011194277B2

(12) United States Patent
Sato

(10) Patent No.: US 11,194,277 B2
(45) Date of Patent: Dec. 7, 2021

(54) IMAGE FORMING APPARATUS

(71) Applicant: KYOCERA Document Solutions Inc., Osaka (JP)

(72) Inventor: Takehiro Sato, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/100,048

(22) Filed: Nov. 20, 2020

(65) Prior Publication Data

US 2021/0165352 A1 Jun. 3, 2021

(30) Foreign Application Priority Data

Nov. 29, 2019 (JP) ..... JP2019-216718

(51) Int. Cl.
*G03G 15/20* (2006.01)
*G03G 21/16* (2006.01)

(52) U.S. Cl.
CPC ..... *G03G 15/2064* (2013.01); *G03G 15/2053* (2013.01); *G03G 21/1685* (2013.01); *G03G 2215/2038* (2013.01)

(58) Field of Classification Search
CPC ..... G03G 15/2017; G03G 15/2032; G03G 15/2035; G03G 15/2053; G03G 21/1685; G03G 2215/2003; G03G 2221/1639
See application file for complete search history.

(56) References Cited

U.S. PATENT DOCUMENTS 6,725,009 B1 4/2004 Tatematsu et al.
2008/0101826 A1 5/2008 Shiga et al.
2014/0348542 A1* 11/2014 Yoshida ..... G03G 15/2032 399/122
2017/0308010 A1* 10/2017 Okajima ..... G03G 15/2053

FOREIGN PATENT DOCUMENTS

JP 2013-174926 9/2013
JP 2018-124506 8/2018

OTHER PUBLICATIONS

EPO, Search Report of EP 20209774.7 dated May 4, 2021.

* cited by examiner

*Primary Examiner* — Thomas S Giampaolo, II
(74) *Attorney, Agent, or Firm* — Lex IP Meister, PLLC

(57) ABSTRACT

A fixing unit fixes the toner image on a sheet by causing the sheet carrying a toner image to pass through a nip portion formed by bringing a rotary fixing member and a rotary pressing member into pressure contact with each other. The image forming apparatus includes an image forming apparatus main body having a fixing unit accommodating portion for accommodating the fixing unit in an insertable and removable manner, and a heating unit provided in the image forming apparatus main body and heating a rotary fixing member of the fixing unit mounted on the fixing unit accommodating portion from outside in a radial direction. The direction in which the fixing unit is inserted into and removed from the fixing unit accommodating portion coincides with the axial direction of the rotary pressing member.

4 Claims, 11 Drawing Sheets

IMAGE FORMING APPARATUS

This application is based upon and claims the benefit of priority from the corresponding Japanese Patent Application No. 2019-216718 filed on Nov. 29, 2019, the entire contents of which are incorporated herein by reference.

BACKGROUND

The present disclosure relates to an image forming apparatus.

In general, an electrophotographic image forming apparatus includes a fixing unit that fixes a toner image on a sheet by a fixing roller and a pressure roller that rotate while being pressed against each other.

In the fixing unit, when the sheet passes through a nip portion formed between the fixing roller and the pressure roller, the toner image on the sheet is heated and pressed to be fixed to the sheet.

The image forming apparatus main body is provided with a heating unit for heating the fixing roller of the fixing unit. An IH heating unit as an example of the heating unit includes a holder and a plurality of IH coils supported by the holder. The holder has a cylindrical recess into which a surface portion of the fixing roller on a side opposite to the nip portion enters. The IH heating unit heats the outer surface of the fixing roller from the outside in the radial direction via the concave portion.

The fixing unit is configured separately from the IH heating unit, and is removably mounted in a fixing unit accommodating portion in the image forming apparatus main body. The insertion/removal direction of the fixing unit is set to a direction facing the inner surface of the concave portion of the holder (a direction orthogonal to the axial direction of the fixing roller).

In the conventional image forming apparatus, since the fixing unit is inserted and removed in a direction facing the inner surface of the concave portion of the holder of the IH heating unit (heating unit), other devices (for example, a drive gear and the like) have to be disposed on the heating unit side with respect to the fixing unit, and the degree of freedom of disposition of the devices is significantly limited.

SUMMARY

An image forming apparatus according to the present disclosure includes a fixing unit, an image forming apparatus main body, and a heating unit. The fixing unit fixes the toner image on the sheet by causing the sheet carrying the toner image to pass through a nip portion formed by bringing a rotary fixing member and a rotary pressing member into pressure contact with each other. The image forming apparatus main body includes a fixing unit accommodating portion that accommodates the fixing unit in an insertable and removable manner. The heating unit is provided in the image forming apparatus main body and heats the rotary fixing member of the fixing unit mounted in the fixing unit accommodating portion from a side opposite to the nip portion side. The direction in which the fixing unit is inserted into and removed from the fixing unit accommodating portion coincides with the axial direction of the rotary pressing member.

DETAILED DESCRIPTION

Hereinafter, embodiments of the present disclosure will be described in detail with reference to the drawings. The present disclosure is not limited to the following embodiments.

Figure 1:
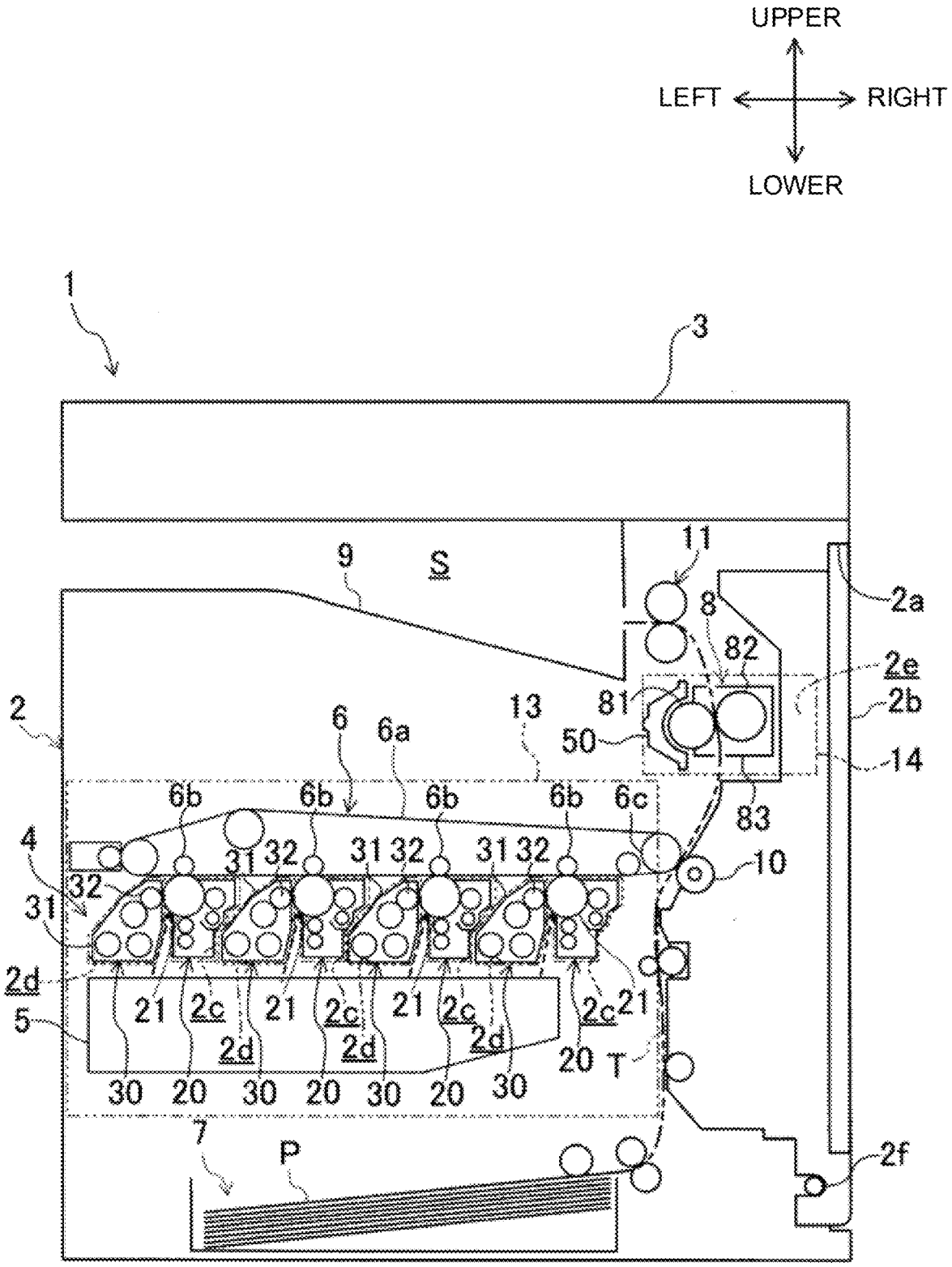
FIG. 1 is a schematic view of an image forming apparatus according to an embodiment.

FIG. 1 is a schematic configuration diagram illustrating an image forming apparatus 1 according to an embodiment. In the following description, the front side and the rear side refer to a front side and a rear side of the image forming apparatus 1 (a front side and a rear side in a direction perpendicular to a paper surface of FIG. 1), and a left side and a right side refer to a left side and a right side when the image forming apparatus 1 is viewed from the front side.

[Overall Configuration of Image Forming Apparatus 1]

The image forming apparatus 1 is an in-body sheet discharge type copying machine and includes an image forming apparatus main body 2 and an image reading device 3 provided on the upper side of the image forming apparatus main body 2. The image reading device 3 optically reads a document image and generates image data thereof.

Inside the image forming apparatus main body 2, an image forming unit 4 that forms an image on a sheet P (an example of a sheet) based on image data of a document read by the image reading device 3 is provided. A transfer unit 6 is disposed above the image forming unit 4. The transfer unit 6 includes an endless intermediate transfer belt 6*a* extending in the left-right direction, 4 primary transfer rollers 6*b* arranged side by side in the left-right direction inside the intermediate transfer belt 6*a*, and a driving roller 6*c* that rotationally drives the intermediate transfer belt.

An exposure device 5 that emits laser light is disposed below the image forming unit 4. Below the exposure device 5, a sheet feeding unit 7 that stores sheets P is disposed. A fixing unit 8 that performs a fixing process on the image transferred and formed on the sheet P is disposed above the right side of the transfer unit 6. Between the image forming apparatus main body 2 and the image reading device 3, there is provided an in-body sheet discharge space S for discharging the sheet P subjected to the fixing process in the fixing unit 8.

On the upper surface of the image forming apparatus main body 2, a sheet discharge tray portion 9 for receiving the sheet P discharged to the in-body sheet discharge space S is formed. Inside the image forming apparatus main body 2, a sheet conveying path T extending from the sheet feeding unit 7 toward the sheet discharge tray portion 9 is provided. Below the fixing unit 8 on the sheet conveying path T, a secondary transfer roller 10 is provided so as to face the driving roller 6*c* with the intermediate transfer belt 6*a* interposed therebetween. On the sheet conveying path T, above the fixing unit 8, a sheet discharge roller pair 11 is provided for discharging the sheet P substantially horizontally toward the sheet discharge tray portion 9.

In the image forming apparatus main body 2, a rectangular opening 2*a* is formed on a right side surface adjacent to the sheet conveying path T. The opening 2*a* can be opened and closed by an opening/closing cover 2*b*. The opening/closing cover 2*b* is rotatably supported with respect to a support shaft 2*f* extending along the lower edge of the opening 2*a*. The opening/closing cover 2*b* is opened by rotating rightward from the closed state with the support shaft 2*f* as a fulcrum. By opening the opening/closing cover 2*b*, the sheet jammed on the sheet conveying path T can be removed.

The image forming unit 4 includes a drum unit 20 and a developing unit 30 that form images of respective colors of yellow, magenta, cyan, and black. The drum unit 20 includes a rotatable photosensitive drum 21. The surface of the photosensitive drum 21 is irradiated with laser light based on predetermined image data from the exposure device 5 to form an electrostatic latent image.

The developing unit 30 includes a developing container 31 and a developing roller 32. Each of the developing containers 31 stores toner, which is a developer, supplied from a corresponding toner container (not shown) of each color. The developing roller 32 is exposed from a right side wall of an upper portion of the developing container 31 and is rotatably supported. A potential difference is generated between the developing roller 32 and the surface of the photosensitive drum 21 to move the toner from the developing roller 32 to the surface of the photosensitive drum 21. The electrostatic latent image on the surface of the photosensitive drum 21 is developed and visualized by the toner moved from the developing roller 32.

The toner images of the respective colors on the respective photosensitive drums 21 visualized by the developing units 30 are sequentially transferred and superimposed on the intermediate transfer belt 6*a* by receiving an applied bias of the primary transfer rollers 6*b* disposed above the respective photosensitive drums 21. The superimposed toner image is transferred to the sheet P when the sheet P supplied from the sheet feeding unit 7 passes between the intermediate transfer belt 6*a* and the secondary transfer roller 10. The sheet P on which the toner image has been transferred is fed to the fixing unit 8.

The fixing unit 8 includes a fixing roller 81 and a pressure roller 82 that are opposed to each other in the left-right direction with the sheet conveying path T interposed therebetween. The fixing unit 8 nips and conveys the sheet P on which the toner image is formed, by the fixing roller 81 and the pressure roller 82. The toner image on the sheet P is heated and pressed when passing between the fixing roller 81 and the pressure roller 82, and is fixed to the sheet P. The sheet P on which the toner image is fixed is discharged to the sheet discharge tray portion 9 by the sheet discharge roller pair 11 disposed on the upper side of the fixing unit 8.

[Accommodating Structure of Respective Units in Image Forming Apparatus Main Body 2]

Next, an accommodating structure of the drum unit 20, the developing unit 30, and the fixing unit 8 in the image forming apparatus main body 2 will be described.

The image forming apparatus main body 2 includes a main body frame 12 (see FIG. 2 and the like) formed by combining a plurality of metal columns and horizontal beams, and an exterior cover (not shown) covering each side surface of the main body frame 12.

The front exterior cover includes a first maintenance door 13 (see FIG. 1) and a second maintenance door 14 (corresponding to an opening/closing door). The first maintenance door 13 extends in a rectangular shape in the left-right direction and covers the entire front side of the image forming unit 4. The first maintenance door 13 is a double-hinged door divided into left and right sides with a center position in the left-right direction as a boundary. The second maintenance door 14 is a square door that covers the entire front side of the fixing unit 8. The second maintenance door 14 is a single-swing door that pivots about a left end portion.

Four pairs of a drum unit accommodating portion 2*c* for accommodating the drum unit 20 and a developing unit accommodating portion 2*d* for accommodating the developing unit 30 are formed adjacent to each other in the left-right direction of the image forming apparatus main body 2 at a position facing the inner side surface of the first maintenance door 13 in the image forming apparatus main body 2.

The drum unit accommodating portion 2*c* is a hollow space portion extending in the front-rear direction, and an insertion/removal opening for inserting and removing the drum unit 20 is provided at a front end portion of the drum unit accommodating portion 2*c*. The drum unit 20 is accommodated in the drum unit accommodating portion 2*c* so as to be insertable and removable in the front-rear direction through the insertion/removal opening.

The developing unit accommodating portion 2*d* is a hollow space portion extending in the front-rear direction, and an insertion/removal opening for inserting and removing the developing unit 30 is provided at a front end portion thereof. The developing unit 30 is accommodated in the developing unit accommodating portion 2*d* so as to be insertable and removable in the front-rear direction through the insertion/removal opening.

A fixing unit accommodating portion 2*e* for accommodating the fixing unit 8 is provided at a place opposed to the inside surface of the second maintenance door 14 in the image forming apparatus main body 2. The fixing unit accommodating portion 2*e* is a hollow space portion extending in the front-rear direction, and an insertion/removal opening for inserting and removing the fixing unit 8 is provided in a front end portion (one side end portion) thereof. A guide member (not shown) that guides the fixing unit 8 in the front-rear direction is provided inside the fixing unit accommodating portion 2*e*. When the fixing unit 8 is completely mounted, the fixing unit 8 is positioned by the guide member so as not to be movable in the left-right direction.

[Detailed Configuration of Fixing Unit Accommodating Portion 2*e*]

Figure 2:
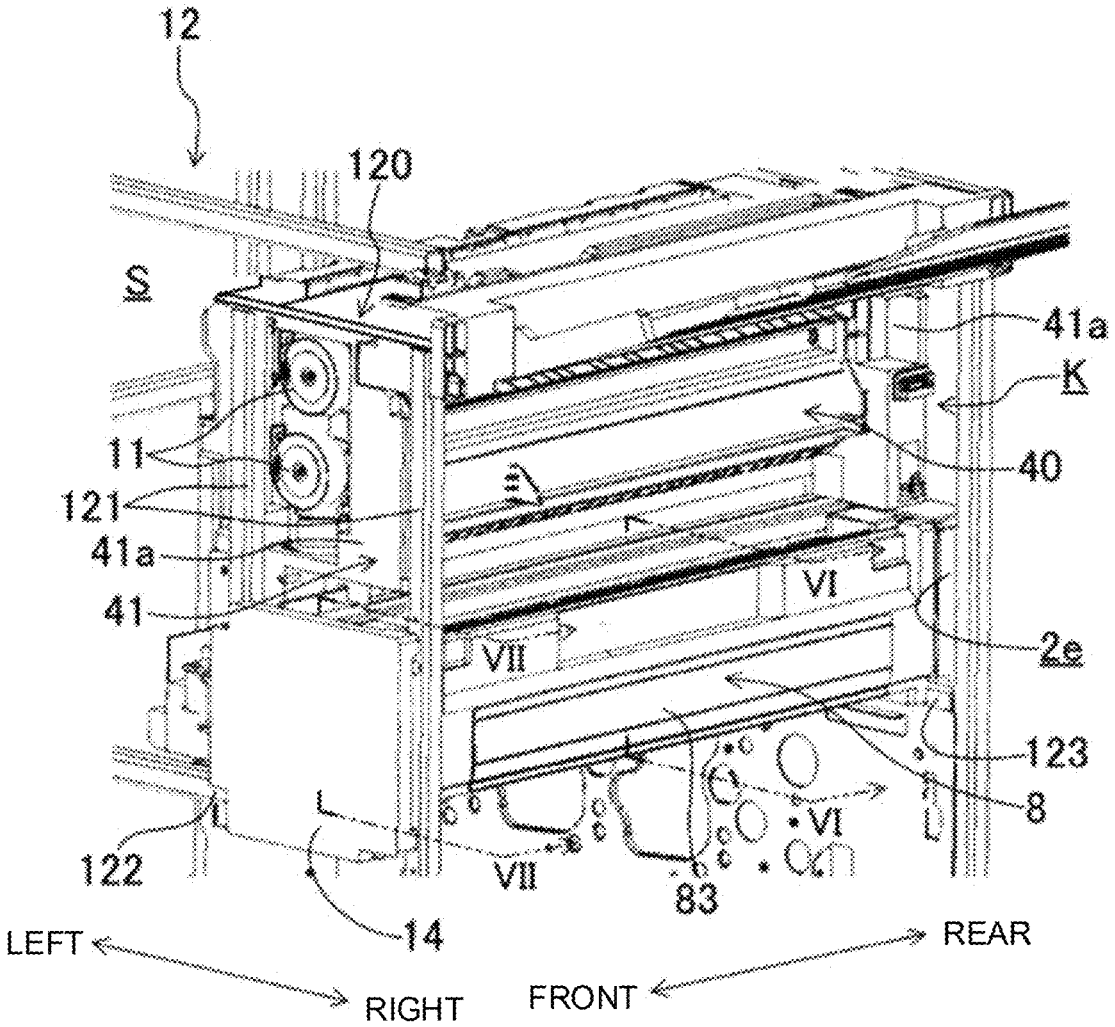
FIG. 2 is a perspective view of a right end portion of the main body frame as viewed obliquely from the front right side, showing a state in which the fixing unit is mounted in the fixing unit accommodating portion and the second maintenance door is fully closed.
Figure 3:
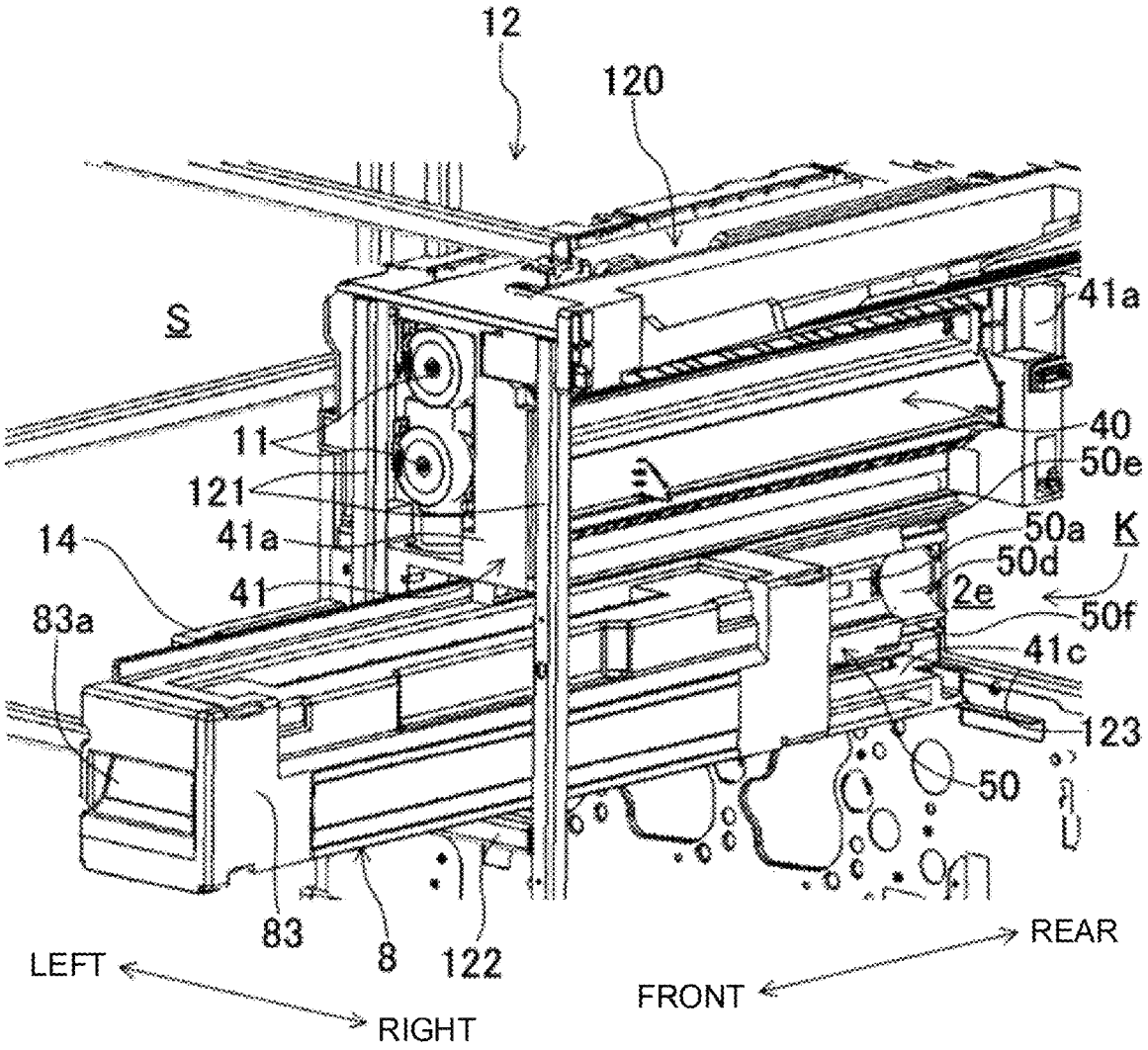
FIG. 3 is a perspective view of the right end portion of the main body frame as viewed obliquely from the front right side, showing a state in which the fixing unit is being inserted and removed.
Figure 4:
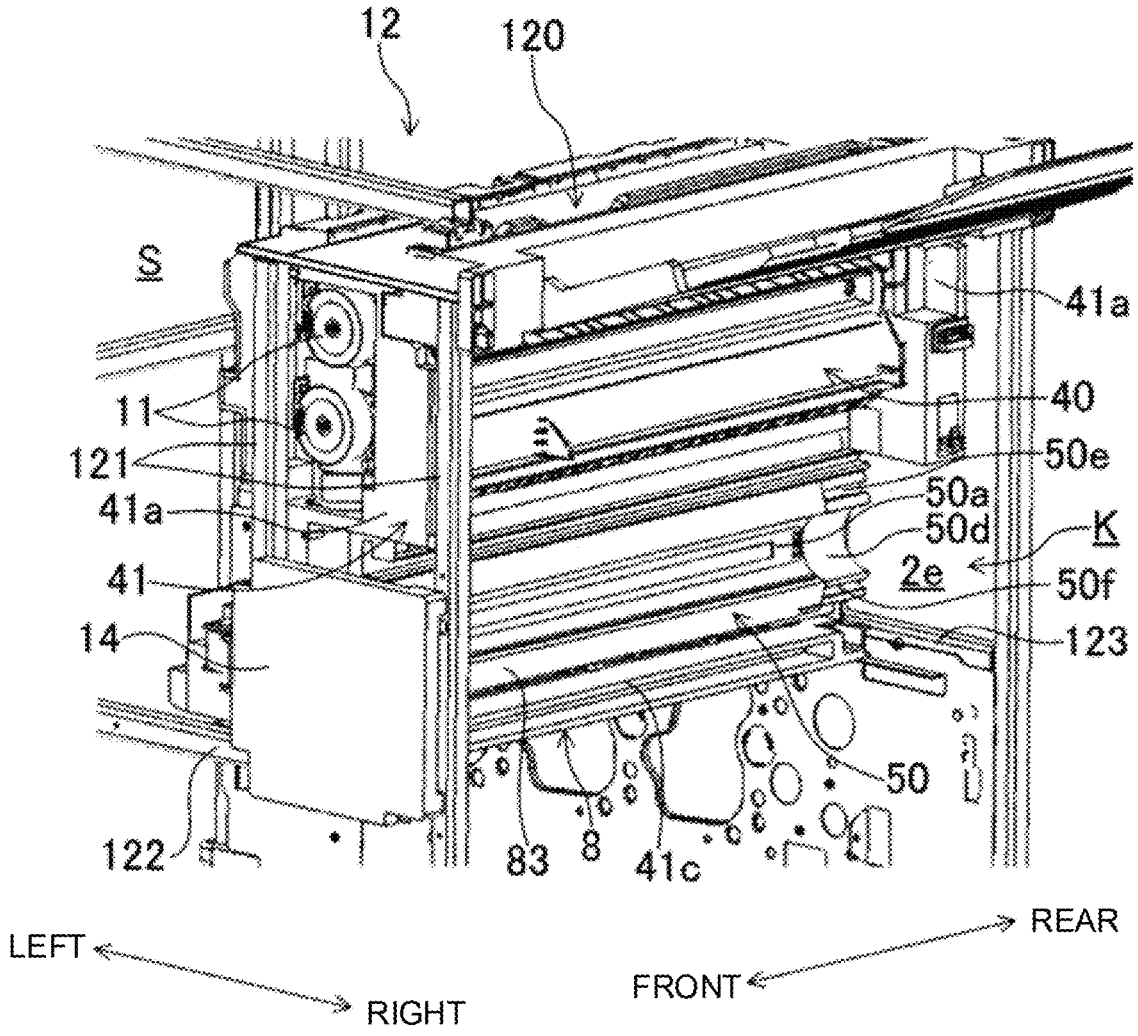
FIG. 4 is a view corresponding to FIG. 2, showing a state in which the fixing unit is removed from the fixing unit accommodating portion.

The fixing unit accommodating portion 2*e* will be described in detail with reference to FIGS. 2 to 4. FIG. 2 shows a state in which the fixing unit 8 is mounted in the fixing unit accommodating portion 2*e* and the second maintenance door 14 is fully closed, and FIG. 3 shows a state in which the fixing unit 8 is being inserted and removed. FIG.

4 corresponds to FIG. 2, showing a state in which the fixing unit 8 is removed from the fixing unit accommodating portion 2e.

The fixing unit accommodating portion 2e is provided in a lower portion of the inner space K of the protruding frame portion 120 provided in the main body frame 12. The protruding frame portion 120 is provided over the entire main body frame 12 in the front-rear direction so as to be adjacent to the right side of the in-body sheet discharge space S. The protruding frame portion 120 is assembled in a rectangular parallelepiped shape by combining frame members.

The discharge unit 40 including the discharge roller pair 11 is accommodated in the inner space K of the protruding frame portion 120, and the fixing unit accommodating portion 2e is constituted by a lower space below the discharge roller pair 11 in the inner space K. The insertion/removal opening of the fixing unit 8 is formed between a pair of left and right columns 121 at the front end portion of the protruding frame portion 120.

[Configuration of Discharge Unit 40]

Figure 5:
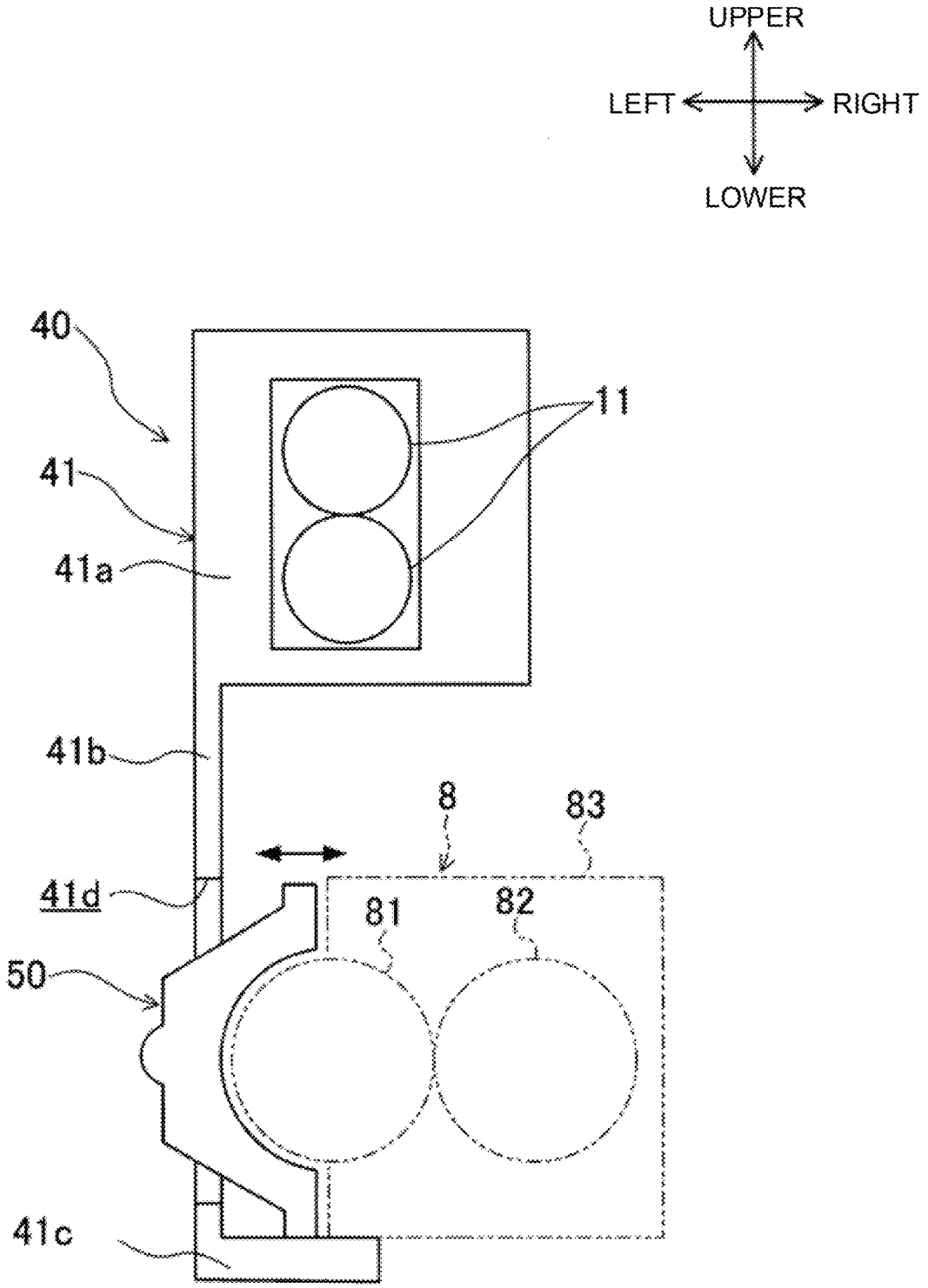
FIG. 5 is a front view of a discharge unit viewed from the front side.

FIG. 5 is a schematic configuration diagram of the discharge unit 40. The discharge unit 40 includes a discharge roller pair 11 and a support frame 41 that supports the sheet discharge roller pair 11. The support frame 41 has a pair of opposed plates 41a supporting both side end portions in the axial direction of the sheet discharge roller pair 11, a vertical plate 41b connecting the left side end portions of the pair of opposed plates 41a and extending in the vertical direction, and a horizontally protruding plate 41c horizontally projecting to the right side from the lower end portion of the vertical plate 41b.

An IH heating unit 50 for heating the fixing roller 81 is supported on the upper surface of the horizontally protruding plate 41c so as to be movable in the left-right direction. An opening 41d through which the IH heating unit 50 can pass is formed on the vertical plate 41b.

The IH heating unit 50 is moved between a heating position and a retracted position by a drive mechanism (drive unit) 60 described later. The heating position is a position where the surface of the fixing roller 81 can be heated by the IH heating unit 50 with a predetermined heating performance. The retracted position is a position where the IH heating unit 50 is moved to the left side from the heating position and retracted to the outside of the movement path of the fixing unit 8.

Figure 6:
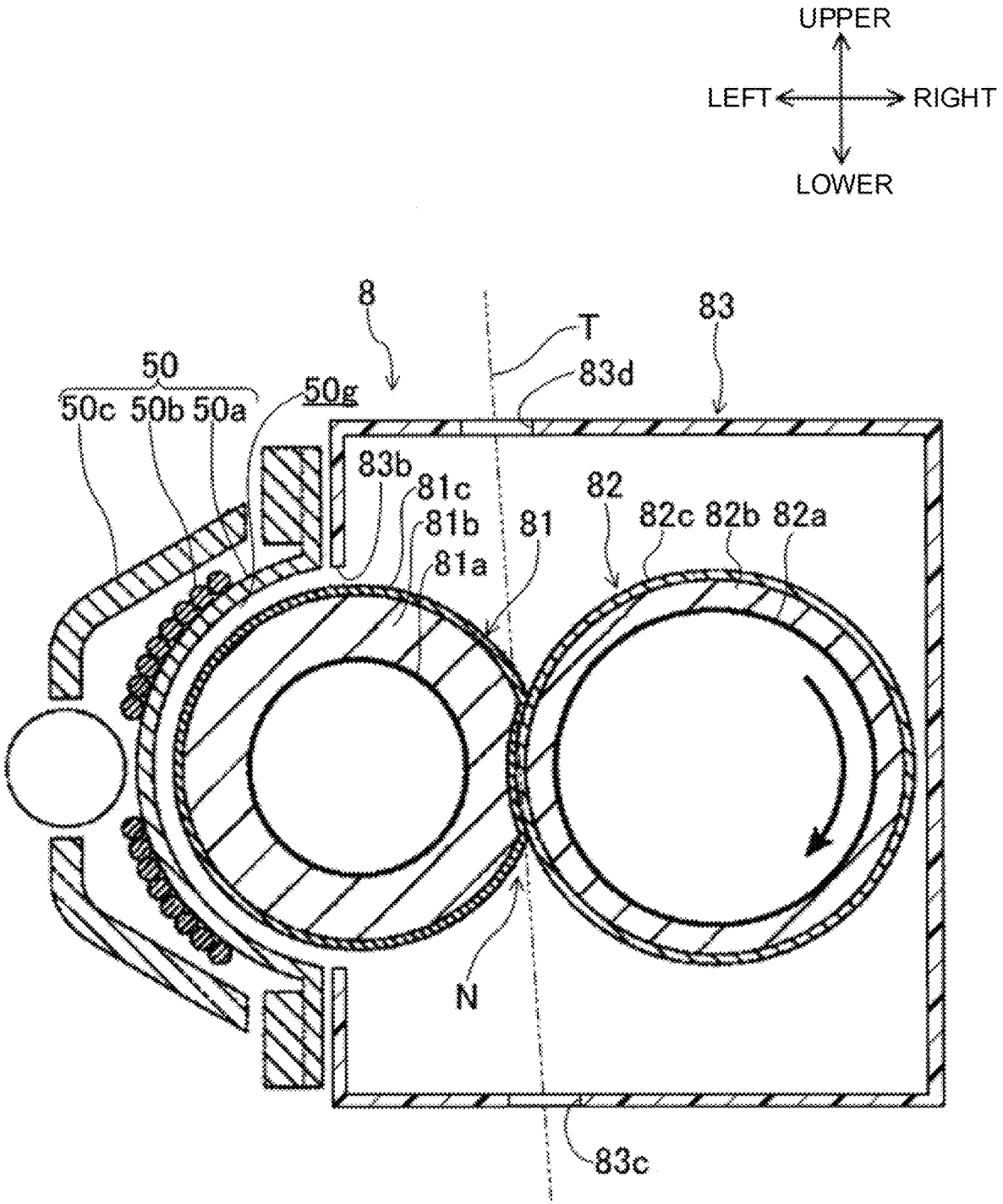
FIG. 6 is a cross-sectional view taken along line VI-VI of FIG. 2.

The fixing unit 8 and the IH heating unit 50 will be described in detail with reference to FIG. 6. FIG. 6 is a cross-sectional view taken along line VI-VI of FIG. 2, and shows a state in which the IH heating unit 50 is at the heating position.

The fixing unit 8 includes the fixing roller 81, the pressure roller 82, and the fixing case 83 as described above.

The fixing roller 81 and the pressure roller 82 are formed in a substantially cylindrical shape elongated in the front-rear direction. The fixing roller 81 includes an elastic layer 81b laminated on the outer peripheral surface of a metallic core 81a, and a fixing belt 81c covering the outer peripheral surface of the elastic layer 81b. The pressure roller 82 includes an elastic layer 82b laminated on the outer peripheral surface of the core metal 82a and a release layer 82c covering the outer peripheral surface of the elastic layer 82b.

The fixing case 83 is formed in a substantially rectangular parallelepiped shape elongated in the front-rear direction. A concave handle portion 83a is formed on the front side surface of the fixing case 83 (see FIG. 3 and the like). The left end portion of the lower surface of the fixing case 83 is supported by the right end portion of the horizontally protruding plate 41c (see FIG. 5) of the discharge unit 40. A front end portion and a rear end portion of the fixing case 83 are respectively supported by a horizontal beam 122 protruding from the front side plate of the main body frame 12 and a horizontal beam 123 protruding from the rear side plate (see FIG. 2).

A sheet receiving port 83c for receiving the sheet P conveyed from the upstream side of the sheet conveying path T is formed on the lower surface of the fixing case 83. A sheet discharge port 83d for discharging the sheet P that has passed through the fixing roller 81 and the pressure roller 82 is formed on the upper surface of the fixing case 83. A rectangular opening 83b extending in the left-right direction is formed on a left side wall of the fixing case 83, and a left half portion of the fixing roller 81 is exposed to the outside of the fixing case 83 from the opening 83b.

The IH heating unit 50 is provided on the opposite side (left side) of the nip portion N with the fixing roller 81 interposed therebetween. The IH heating unit 50 includes a semi-cylindrical holder 50a that opens to the fixing roller 81 side, a plurality of IH coils 50b supported by the holder 50a, and an arch core 50c formed of a ferromagnetic material such as ferrite and covering the IH coils 50b. The inner surface of the holder 50a forms a semi-cylindrical concave portion 50g, and in a state where the IH heating unit 50 is at the heating position, an outer peripheral surface of the fixing roller 81 on a side opposite to the nip portion N side enters the concave portion 50g. Both the holder 50a and the arch core 50c are opposed to the fixing roller 81 and extend over the whole in the front-rear direction. Both end portions of the holder 50a and the arch core 50c in the front-rear direction are connected to a positioning block portion 50d (see FIG. 4) described later.

At the time of the fixing process, the pressure roller 82 is connected to a motor or the like (not shown) via a gear train or the like, and receives a driving force of the motor to rotate. The fixing roller 81 is rotated by the pressure roller 82 about its axis. Each IH coil 50b is supplied with electric power from a power source (not shown) and generates a high-frequency magnetic field to heat the fixing belt 81c. The fixing roller 81 heats the toner image on the sheet P passing through the nip portion N while rotating. The pressure roller 82 presses the sheet P passing through the nip portion N while rotating. Thus, the toner image is fixed on the sheet P. It should be noted that the fixing roller 81 may be driven to rotate the pressure roller 82.

[Positioning Structure of IH Heating Unit 50]

As described above, the IH heating unit 50 is configured to be movable between the heating position and the retracted position. The IH heating unit 50 is positioned so that a clearance between the inner surface of the concave portion 50g of the holder 50a and the outer peripheral surface of the fixing roller 81 becomes a preset distance at the heating position.

Figure 7:
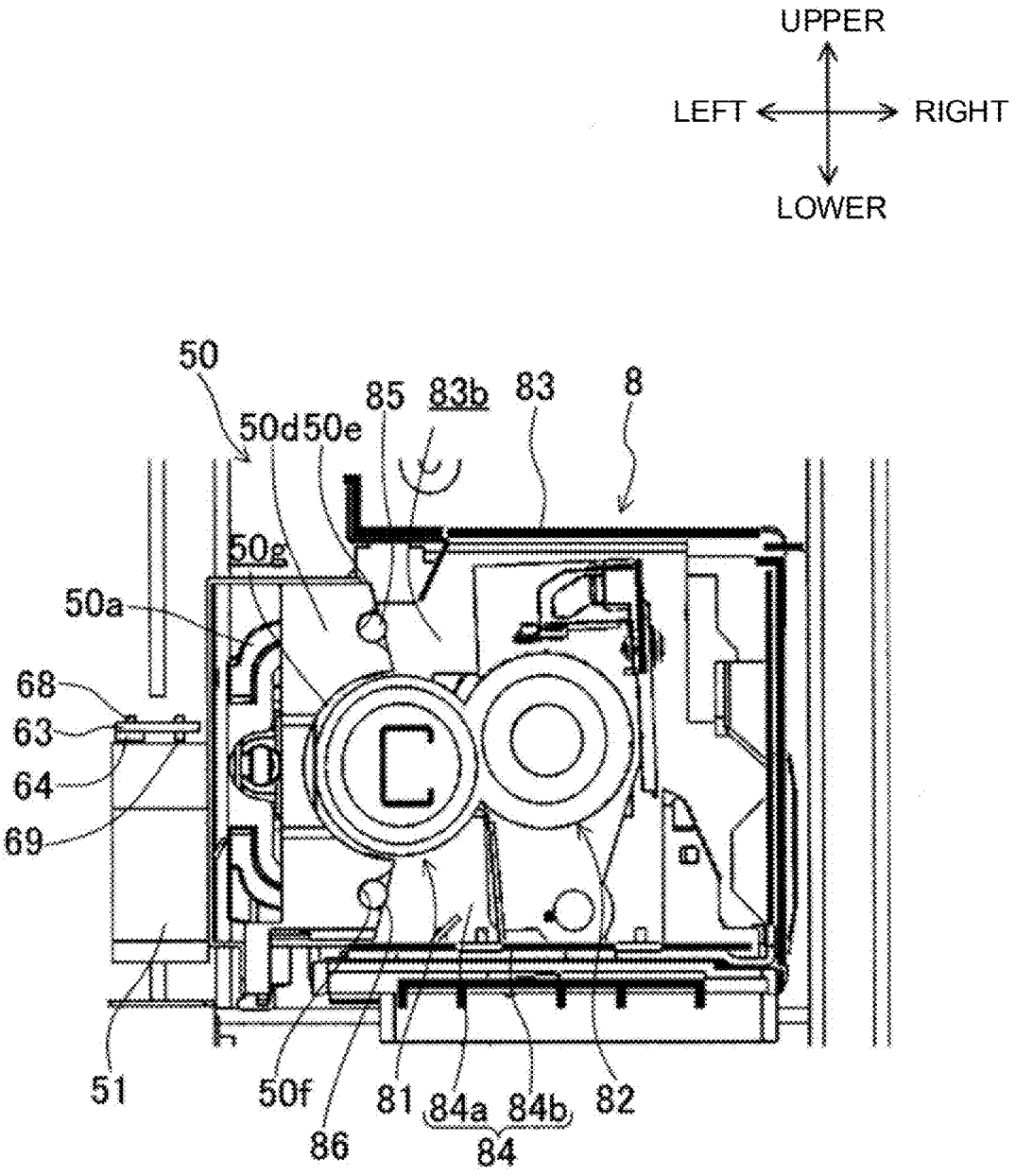
FIG. 7 is a cross-sectional view taken along line VII-VII of FIG. 2.

A configuration for positioning the IH heating unit 50 will be described with reference to FIGS. 4 7, and 8. Referring first to FIGS. 4 and 7, positioning block portions 50d (only the rear block portion is shown in FIG. 4) are provided at both end portions of the IH heating unit 50 in the front-rear direction. A cylindrical surface continuously connected to the inner surface of the concave portion 50g of the holder 50a is formed on the right side surface of each positioning block portion 50d. An upper engagement groove 50e and a lower engagement groove 50f are formed on the upper and lower sides of the cylindrical surface of each positioning block portion 50d. The upper engagement groove 50e and the lower engagement groove 50*f* are semi-cylindrical grooves extending in the front-rear direction.

Figure 8:
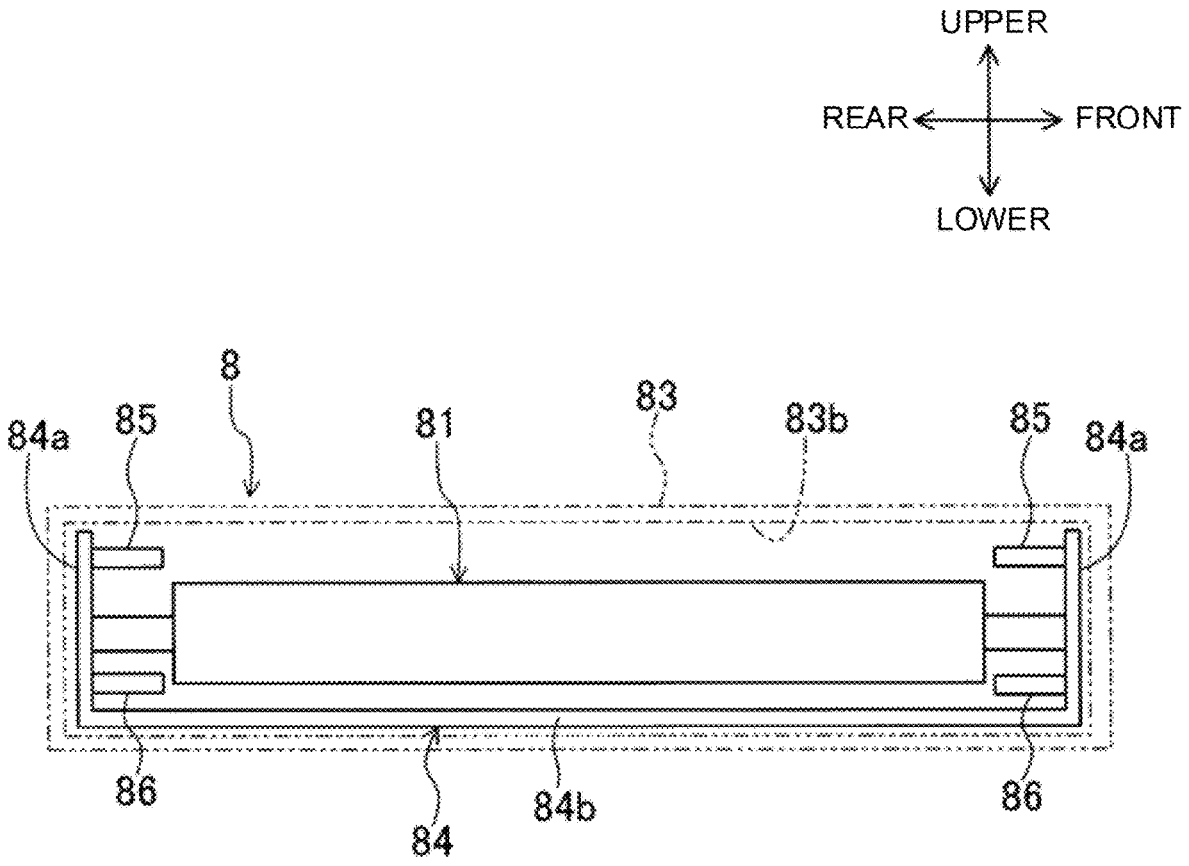
FIG. 8 is a schematic side view of the fixing unit viewed from the opening side.

As shown in FIGS. 7 and 8, the fixing unit 8 includes an upper engagement pin 85 that engages with the upper engagement groove 50*e* of each positioning block portion 50*d* and a lower engagement pin 86 that engages with the lower engagement groove 50*f* of each positioning block portion 50*d*.

The upper engagement pin 85 and the lower engagement pin 86 are attached to a support member 84 that supports the fixing roller 81 and the pressure roller 82. The support member 84 is formed of, for example, a metal plate member. The support member 84 includes a pair of vertical support plates 84*a* that face each other in the front-rear direction and support both ends of the fixing roller 81 and the pressure roller 82, and a connection plate 84*b* that connects lower end portions of the pair of vertical support plates 84*a* to each other. The upper engagement pin 85 protrudes inward in the front-rear direction from the upper left corner of each vertical support plate 84*a*. The lower engagement pin 86 protrudes inward in the front-rear direction from a lower left corner of each vertical support plate 84*a*.

As shown in FIG. 7, the IH heating unit 50 is positioned at the heating position by engaging the upper engagement groove 50*e* and the lower engagement groove 50*f* of the positioning block portion 50*d* with the upper engagement pin 85 and the lower engagement pin 86 of the fixing unit 8, respectively.

In a state in which the IH heating unit 50 is at the heating position, a part of the positioning block portion 50*d* and a part of the support member 84 of the fixing unit 8 overlap each other as viewed in the front-rear direction. Therefore, the IH heating unit 50 cannot be inserted and removed in the front-rear direction. Therefore, in the present embodiment, when the user opens the second maintenance door 14 (an example of an operation portion) in order to perform the insertion and removal operation of the fixing unit 8, the IH heating unit 50 is moved from the heating position to the retracted position by the drive mechanism 60.

[Drive Mechanism 60 of IH Heating Unit 50]

Figure 9:
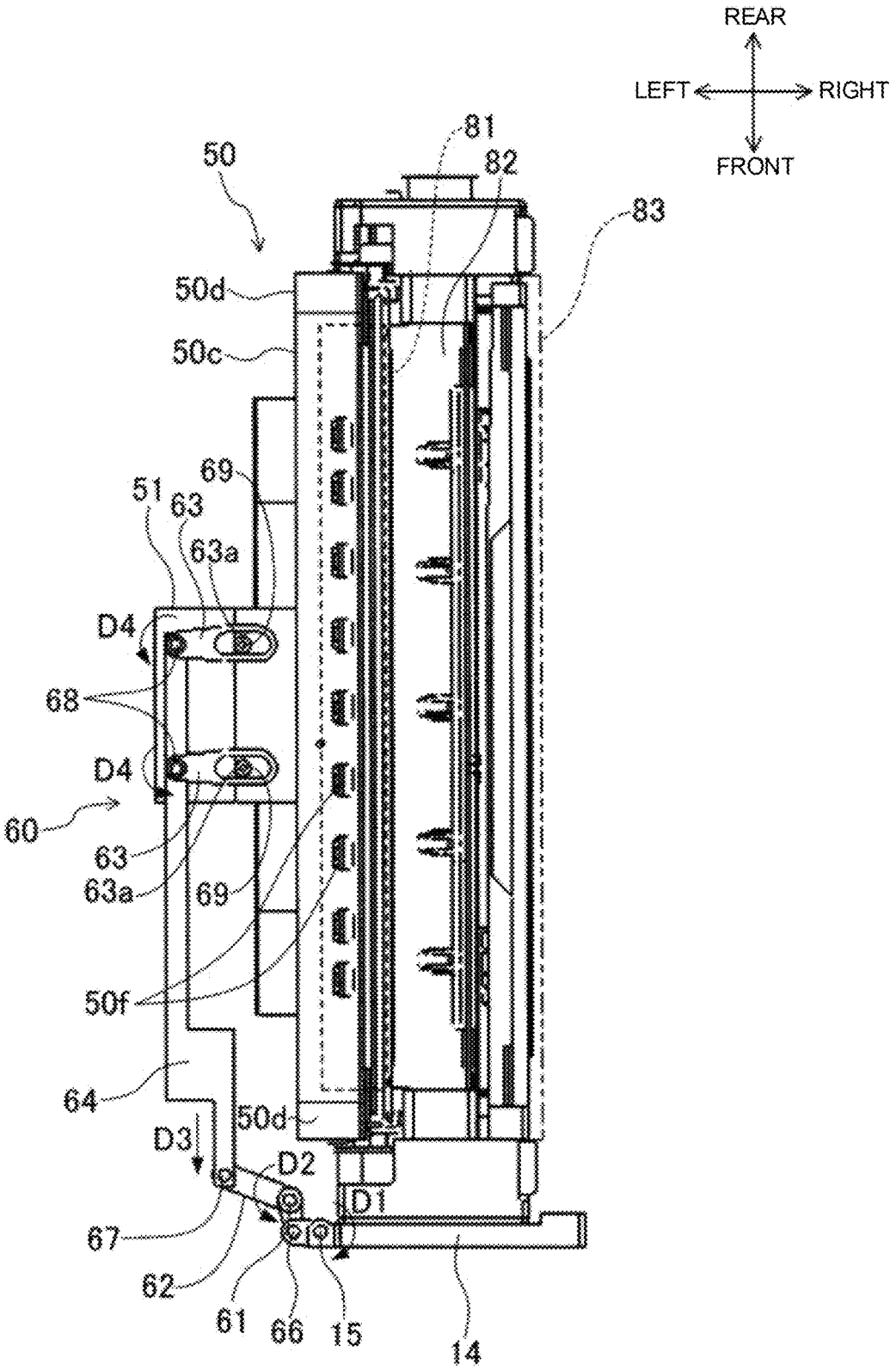
FIG. 9 is a plan view showing a state in which the fixing unit is mounted in the fixing unit accommodating portion and the second maintenance door is fully closed.

An example of the drive mechanism 60 will be described with reference to FIG. 9. FIG. 9 shows a state in which the IH heating unit 50 is moved to the heating position by the drive mechanism 60. In the description of the components of the drive mechanism 60, unless otherwise specified, the IH heating unit 50 is assumed to be in the heating position.

The drive mechanism 60 is constituted by a link mechanism that interlocks with the opening and closing operation of the second maintenance door 14. Specifically, the drive mechanism 60 includes a door-side link bar 62 connected to the second maintenance door 14, a pair of parallel link bars 63 connected to the upper surface of the cooling duct 51 of the IH heating unit 50, and an intermediate link bar 64 connecting the door-side link bar 62 and the pair of parallel link bars 63.

The door-side link bar 62 is a plate-like member bent in a dogleg shape in a plan view, and extends from the front side toward the rear side and then extends obliquely rearward toward the left side.

An intermediate portion of the door-side link bar 62 is supported so as to be rotatable about a door-side fixed shaft 61 that is provided diagonally to the rear left of the second maintenance door 14. The door-side fixed shaft 61 protrudes from a front horizontal beam 122 (see FIG. 4) constituting a lower side of a front end portion of the protruding frame portion 120.

A front end portion of the door-side link bar 62 is coupled to a left end portion of the second maintenance door 14 via a coupling pin 66. The door-side link bar 62 and the second maintenance door 14 are connected to each other so as to be rotatable about the coupling pin 66.

A rear end portion of the door-side link bar 62 is coupled to a front end portion of the intermediate link bar 64 via a coupling pin 67. The intermediate link bar 64 and the door-side link bar 62 are connected so as to be rotatable about the coupling pin 67.

The intermediate link bar 64 is formed of a plate-like member that extends linearly toward the rear side and then bends stepwise to extend linearly toward the rear side. The pair of parallel link bars 63 are connected to the rear end of the intermediate link bar 64 via coupling pins 68. The intermediate link bar 64 and the pair of parallel link bars 63 are connected to each other so as to be rotatable about each coupling pin 68.

The pair of parallel link bars 63 are plate-like members extending in the left-right direction. Each parallel link bar 63 has an elliptical long hole 63*a* extending from the right end portion to the vicinity of the center. A fixing pin 69 is inserted into each long hole 63*a*. The fixing pin 69 protrudes from the upper surface of the cooling duct 51 of the IH heating unit 50. The cooling duct 51 supplies air taken into the image forming apparatus main body 2 by a blower fan (not shown) to a space between the arch core 50*c* and the holder 50*a* of the IH heating unit 50. The IH coils 50*b* are cooled by the supplied air. In FIG. 9, reference numeral 50*f* denotes vent holes formed through the upper wall of the arch core 50*c*.

[Description of Operation of Drive Mechanism 60]

Figure 10:
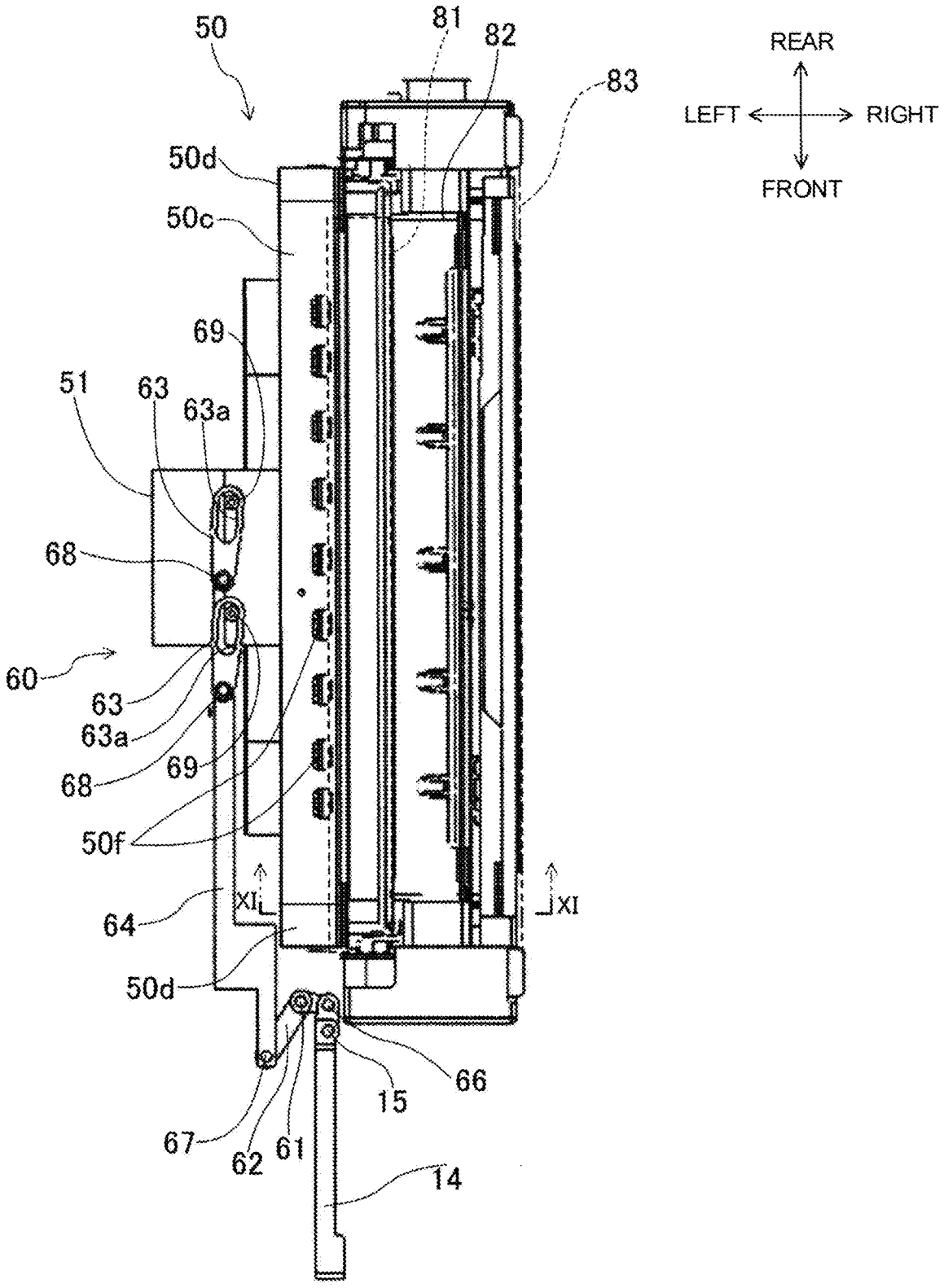
FIG. 10 is a view corresponding to FIG. 9, showing a state in which the second maintenance door is fully opened.

Next, with reference to FIGS. 9 and 10, the operation of the drive mechanism 60 associated with the opening and closing operation of the second maintenance door 14 will be described. FIG. 9 shows a state in which the second maintenance door 14 is closed (hereinafter referred to as a fully closed state), and FIG. 10 shows a state in which the second maintenance door 14 is rotated by 90 degrees from the fully closed state to the front side about the fixing pin 15 (hereinafter referred to as a fully opened state).

When the second maintenance door 14 is rotated in the clockwise direction (D1 direction) around the fixing pin 15 from the fully closed state thereof (the state of FIG. 9), the front end portion of the door-side link bar 62 moves obliquely rearward to the right along the circular track around the fixing pin 15 together with the coupling pin 66. Accordingly, the door-side link bar 62 rotates in the counterclockwise direction (D2 direction) about the door-side fixed shaft 61, and the intermediate link bar 64 is pulled out to the front side (D3 direction) by the door-side link bar 62. As a result, the pair of parallel link bars 63 connected to the rear end portion of the intermediate link bar 64 rotate in the counterclockwise direction (D4 direction) about the coupling pins 68. When the pair of parallel link bars 63 are rotated, the fixing pin 69 inserted into the long hole 63*a* is pushed to the left side by the inner surface of the long hole 63*a* while relatively moving in the longitudinal direction of the long hole 63*a*. As a result, the IH heating unit 50 moves to the left together with the fixing pin 69. When the second maintenance door 14 is rotated to be fully opened, as shown in FIG. 10, the IH heating unit 50 moves to the retracted position outside the insertion/removal path of the fixing unit 8.

Figure 11:
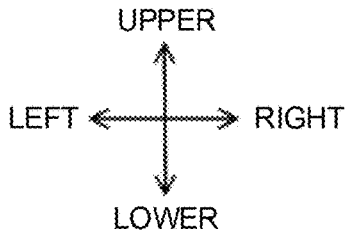
FIG. 11 is a cross-sectional view taken along line XI-XI of FIG. 10.
Figure 11:
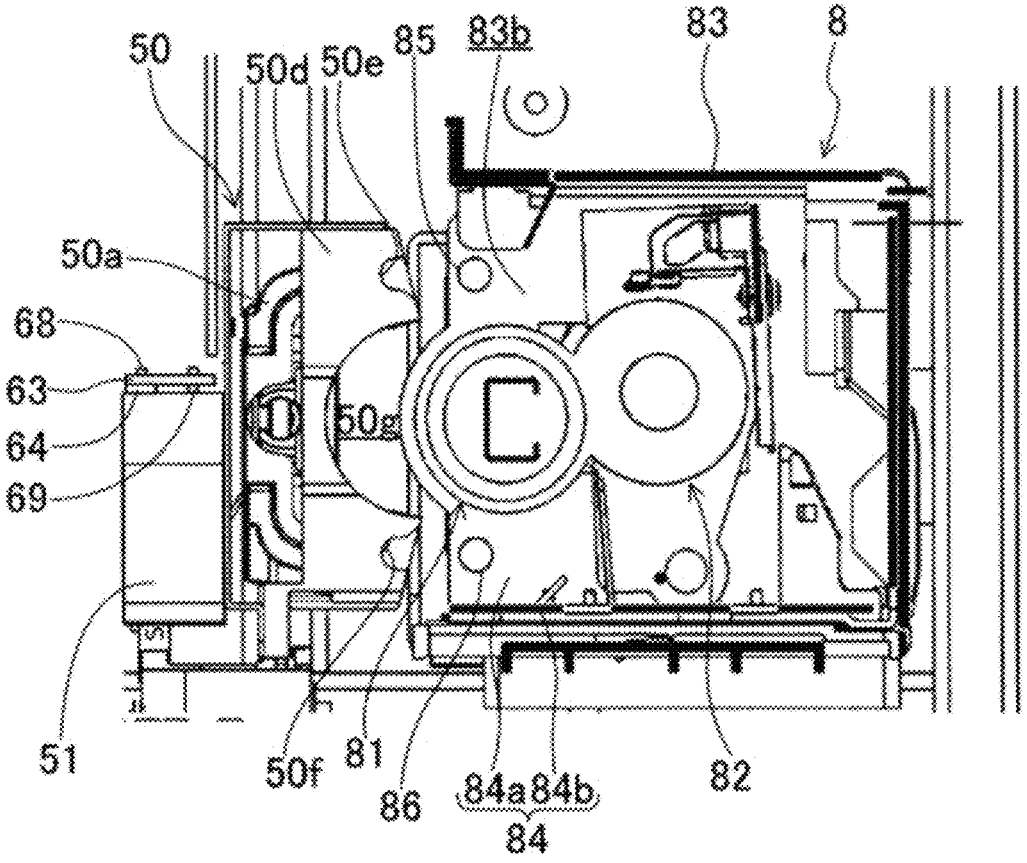

When the IH heating unit 50 moves to the retracted position, as shown in FIG. 11, the entire positioning block portion 50*d* of the IH heating unit 50 is retracted to the left of the support member 84 of the fixing unit 8, and the engagement between the engagement pins 85, 86 and the engagement grooves 50*e*, 50*f* is released. Therefore, by moving the IH heating unit 50 to the retracted position, the fixing unit 8 can be inserted and removed in the front-rear direction without interfering with the IH heating unit 50.

[Effects]

As described above, in the present embodiment, the insertion/removal direction (front-rear direction) of the fixing unit 8 with respect to the fixing unit accommodating portion 2*e* coincides with the axial direction of the pressure roller 82.

According to this configuration, it is possible to improve the degree of freedom of arrangement of the other components as compared with a case where the insertion/removal direction of the fixing unit 8 is set to a direction (left-right direction) orthogonal to the axial direction of the pressure roller 82. Examples of the other components include a drive gear for driving the pressure roller 82. The drive gear transmits the power of the motor to a roller gear fixed to the core metal 82*a* of the pressure roller 82. In the conventional image forming apparatus, since it is necessary to take out the fixing unit 8 from the fixing unit accommodating portion 2*e* to the right side, the drive gear cannot be disposed on the right side of the roller gear. Therefore, depending on the arrangement position of the drive gear, a load (a component force in a direction of separating the pressure roller 82 from the fixing roller 81) that reduces the nip pressure may act on the roller gear.

In contrast, in the present embodiment, since the drive gear can be disposed on any of the front, rear, left, and right sides of the roller gear, the drive gear can be disposed at an appropriate position where the nip pressure does not decrease.

Further, in the present embodiment, the image forming apparatus 1 includes the drive mechanism 60 that moves the IH heating unit 50, and the drive mechanism 60 is configured to be capable of driving the IH heating unit 50 between a preset heating position where the fixing roller 81 of the fixing unit 8 mounted in the fixing unit accommodating portion 2*e* can be heated and a retracted position where the IH heating unit 50 is moved to the left side of the heating position (to the outside in the radial direction of the fixing roller 81) and retracted to the outside of the insertion/removal path of the fixing unit 8.

The drive mechanism 60 is configured to be capable of selectively switching the position of the IH heating unit 50 between the heating position and the retracted position in conjunction with the opening and closing operation of the second maintenance door 14 as an operation portion that can be operated by a user.

According to this configuration, it is possible to move the IH heating unit 50 to the retracted position by operating the operation portion when the insertion and removal work of the fixing unit 8 is necessary, and to move the IH heating unit 50 to the heating position by operating the operation portion when the fixing process by the fixing unit 8 is executed. Therefore, even when the insertion/removal direction of the fixing unit 8 is set to the front-rear direction, the fixing unit 8 and the IH heating unit 50 do not interfere with each other during the insertion/removal operation of the fixing unit 8.

In the present embodiment, the drive mechanism 60 is configured to position the IH heating unit 50 at the heating position when the second maintenance door 14 as the operation portion is in the fully closed state, and to position the IH heating unit 50 at the retracted position when the second maintenance door 14 is in a predetermined open position (in the example of the present embodiment, a fully open state rotated by 90° from the fully closed state) at which the fixing unit 8 can be inserted and removed from the insertion/removal opening.

According to this configuration, the user can move the IH heating unit 50 to an appropriate position according to the opening and closing operation of the second maintenance door 14 without selecting which of the heating position and the retracted position the IH heating unit 50 is to be positioned at. That is, when the user opens the second maintenance door 14 to perform the insertion and removal operation of the fixing unit 8, the IH heating unit 50 is moved to the retracted position by the drive mechanism 60. Therefore, the user does not need to perform an operation of moving the IH heating unit 50 to the retracted position separately from the operation of opening the second maintenance door 14. When the user attaches the fixing unit 8 to the fixing unit accommodating portion 2*e* and fully closes the second maintenance door 14, the IH heating unit 50 is moved to the heating position by the drive mechanism 60. Therefore, the user does not need to perform an operation of moving the IH heating unit 50 to the heating position separately from the operation of closing the second maintenance door 14. Accordingly, a labor is decreased during the insertion and removal operation of the fixing unit 8.

In addition, in the present embodiment, the IH heating unit 50 is employed as a heating unit that heats the fixing roller 81. The IH heating unit 50 includes a holder 50*a* having a concave portion 50*g* for receiving a surface portion of the fixing roller 81 on a side opposite to the nip portion N side, a plurality of IH coils 50*b* supported by the holder 50*a*, and an arch core 50*c* covering the IH coils 50*b*.

As described above, when the IH heating unit 50 is employed, the outer peripheral surface of the fixing roller 81 on the side opposite to the nip portion N side enters the concave portion 50*g* of the holder 50*a*. Therefore, when the fixing unit 8 is inserted and removed in the axial direction, the fixing unit 8 and the IH heating unit 50 tend to interfere with each other. In such a configuration, it is particularly effective to employ the drive mechanism 60 capable of moving the IH heating unit 50 to the retracted position in order to avoid interference.

In the present embodiment, the image forming apparatus main body 2 includes a drum unit accommodating portion 2*c* that accommodates the drum unit 20 so as to be insertable and removable in the same direction as the insertion and removal direction of the fixing unit 8, and a developing unit accommodating portion 2*d* that accommodates the developing unit 30 so as to be insertable and removable in the same direction as the insertion and removal direction of the fixing unit 8 (see FIG. 1). The opening for insertion and removal of the fixing unit 8 in the fixing unit accommodating portion 2*e*, the opening for insertion and removal of the drum unit 20 in the drum unit accommodating portion 2*c*, and the opening for insertion and removal of the developing unit 30 in the developing unit accommodating portion 2*d* are open on the same side (front side) of the image forming apparatus main body 2.

According to this configuration, the user can perform maintenance work of the drum unit 20, the developing unit 30, and the fixing unit 8 from the front side of the image forming apparatus main body 2. Therefore, unlike in conventional cases, it is not necessary to take the trouble to perform the maintenance work of the drum unit 20 and the developing unit 30 from the front side of the image forming apparatus main body 2, and the maintenance work of the fixing unit 8 from the right side of the image forming apparatus main body 2. Therefore, maintenance work of the image forming apparatus 1 can be facilitated.

Other Embodiments

In the above-described embodiment, the link mechanism (drive mechanism 60) is employed as the drive unit for moving the IH heating unit 50 between the heating position and the retracted position. The drive unit may have an electric motor as a drive source. In this case, the second maintenance door 14 and the drive switch of the electric motor may be interlocked with each other. A command for driving the electric motor may be issued from an operation panel of the image forming apparatus main body 2.

In the above-described embodiment, the upper engagement groove 50*e* and the lower engagement groove 50*f* are formed in the positioning block portion 50*d* of the IH heating unit 50, and the engagement grooves 50*e* and 50*f* are engaged with the upper engagement pin 85 and the lower engagement pin 86 of the fixing unit 8, respectively. However, the present disclosure is not limited thereto. For example, the lower engagement groove 50*f* and the lower engagement pin 86 may be eliminated, and positioning may be performed only by the upper engagement groove 50*e* and the upper engagement pin 85. That is, the positioning structure may have any configuration as long as the distance between the inner surface of the concave portion 50*g* of the holder 50*a* and the outer peripheral surface of the fixing roller 81 can be regulated to a predetermined distance.

In the above-described embodiment, the fixing roller 81 is described as an example of the rotary fixing member. However, the rotary fixing member is not limited thereto, and may be an endless fixing belt. In the above-described embodiment, the pressure roller 82 is described as an example of the rotary pressure member. However, the rotary pressure member is not limited thereto, and may be an endless pressure belt.

As described above, the present invention is useful for an image forming apparatus, and is particularly useful when applied to a printer, a facsimile, a copying machine, a multifunction peripheral (MFP), or the like.

What is claimed is:

1. An image forming apparatus comprising:

a fixing unit including a rotary fixing member and a rotary pressing member, that fixes a toner image on a sheet by causing the sheet carrying the toner image to pass through a nip portion formed by bringing the rotary fixing member and the rotary pressing member into pressure contact with each other;

an image forming apparatus main body including a fixing unit accommodating portion that accommodates the fixing unit in an insertable and removable manner;

a heating device provided in the image forming apparatus main body, that heats the rotary fixing member of the fixing unit mounted in the fixing unit accommodating portion from a side opposite to the nip portion side;

a drive mechanism that moves the heating device between a heating position set in advance to heat the rotary fixing member of the fixing unit mounted in the fixing unit accommodating portion and a retracted position which is more outward from an insertion/removal path of the fixing unit than the heating position in a radial direction of the rotary fixing member; and an operation unit operable by a user, wherein an insertion/removal direction in which the fixing unit is inserted into and removed from the fixing unit accommodating portion coincides with an axial direction of the rotary pressing member, and wherein the drive mechanism selectively switches a position of the heating device between the heating position and the retracted position in conjunction with an operation of the operation unit.

2. The image forming apparatus according to claim 1, wherein an insertion/removal opening through which the fixing unit is inserted and removed is formed at one side end portion of the fixing unit accommodating portion in the insertion/removal direction of the fixing unit, and the image forming apparatus further comprising:

an opening/closing door that openably and closably closes the insertion/removal opening, wherein the operation unit includes the opening/closing door, and the drive mechanism is configured to, as the operation unit, position the heating device at the heating position in a state in which the opening/closing door is in a fully closed state, and to position the heating device at the retracted position in a state in which the opening/closing door is in a predetermined open position in which the fixing unit can be inserted and removed through the insertion/removal opening.

3. The image forming apparatus according to claim 1, further comprising:

a drum unit including a photosensitive drum carrying a toner image; and a developing unit including a developing roller that forms a toner image on the photosensitive drum, wherein the image forming apparatus main body includes a drum unit accommodating portion that accommodates the drum unit so as to be insertable into and removable in a same direction as the insertion/removal direction of the fixing unit, and a developing unit accommodating portion that accommodates the developing unit so as to be insertable and removable in a same direction as the insertion/removal direction of the fixing unit, and an opening for insertion and removal of the fixing unit in the fixing unit accommodating portion, an opening for insertion and removal of the drum unit in the drum unit accommodating portion, and an opening for insertion and removal of the developing unit in the developing unit accommodating portion are all open on a same side of the image forming apparatus main body.

4. The image forming apparatus according to claim 1, wherein the heating device is an IH heating device including a holder having a concave portion that receives an outer peripheral surface of the rotary fixing member opposite to the nip portion side, a plurality of IH coils supported by the holder, and an arch core that covers the IH coils.

* * * * *